US011672317B2

(12) United States Patent
Mody

(10) Patent No.: US 11,672,317 B2
(45) Date of Patent: Jun. 13, 2023

(54) WATERPROOF CASE

(71) Applicant: CASE-MATE, INC., Atlanta, GA (US)

(72) Inventor: Saumil Chetan Mody, Atlanta, GA (US)

(73) Assignee: CASE-MATE, INC., Atlanta, GA (US)

( * ) Notice: Subject to any disclaimer, the term of this patent is extended or adjusted under 35 U.S.C. 154(b) by 0 days.

(21) Appl. No.: 17/363,538

(22) Filed: Jun. 30, 2021

(65) Prior Publication Data

US 2022/0000237 A1 Jan. 6, 2022

Related U.S. Application Data

(60) Provisional application No. 63/047,366, filed on Jul. 2, 2020.

(51) Int. Cl.

| | |
|---|---|
| ***A45C 13/00*** | (2006.01) |
| ***A45C 11/00*** | (2006.01) |
| ***A45C 13/02*** | (2006.01) |

(52) U.S. Cl.

CPC ..... *A45C 13/008* (2013.01); *A45C 11/00* (2013.01); *A45C 13/005* (2013.01); *A45C 13/02* (2013.01); *A45C 2011/001* (2013.01)

(58) Field of Classification Search

CPC ..... A45C 11/00; A45C 13/00; A45C 13/005; A45C 13/008; A45C 13/02; A45C 2011/001

USPC ..... 206/320

See application file for complete search history.

(56) References Cited

U.S. PATENT DOCUMENTS

| | | | | |
|---|---|---|---|---|
| 6,646,864 | B2 * | 11/2003 | Richardson | G06F 1/1626 206/305 |
| 7,158,376 | B2 | 1/2007 | Richardson et al. | |
| 7,180,735 | B2 | 2/2007 | Thomas et al. | |
| D543,700 | S | 6/2007 | Parker et al. | |
| 7,609,512 | B2 | 10/2009 | Richardson et al. | |
| 7,805,172 | B2 | 9/2010 | Joo | |
| 7,907,394 | B2 | 3/2011 | Richardson et al. | |
| 8,573,397 | B1 * | 11/2013 | Fager | B65B 61/26 206/320 |
| 8,789,699 | B2 | 7/2014 | Patstone et al. | |
| 8,863,953 | B1 * | 10/2014 | Fager | B65D 1/36 206/320 |
| 9,882,596 | B2 | 1/2018 | Flores et al. | |
| 2009/0114556 | A1 | 5/2009 | Tai et al. | |
| 2013/0113348 | A1 | 5/2013 | Holben et al. | |
| 2021/0029424 | A1 * | 1/2021 | Wright | H04R 1/02 |

* cited by examiner

*Primary Examiner* — Bryon P Gehman

(74) *Attorney, Agent, or Firm* — Gardner Groff & Greenwald, PC

(57) ABSTRACT

A protective case for housing a protected device such as audio earbuds. In some examples the case may include a water-resistant seal to prevent damage to the protected device, an impact-resistant outer housing and/or an impact absorbing inner housing portion. The case may include upper and lower portions hingedly or pivotally coupled to one another. In example applications wherein the protected device includes a hinged container, eccentric or offset hinge axes of the case and the protected device effect a cam or fulcrum action that assists in opening and/or raising the protected device container for ease of access to the protected device when the case is opened.

18 Claims, 8 Drawing Sheets

WATERPROOF CASE

CROSS-REFERENCE TO RELATED APPLICATION

This application claims the benefit of U.S. Provisional Patent Application Ser. No. 63/047,366 filed Jul. 2, 2020, the entirety of which is hereby incorporated herein by reference for all purposes.

TECHNICAL FIELD

The present disclosure relates generally to the field of protective cases, and more particularly to a waterproof or water-resistant case for earbuds or other electronic devices.

BACKGROUND

Earbuds (also referred to as earphones, in-ear speakers or headphones, ear pods, etc.), are commonly used in wired or wireless connection with smartphones, tablet computers, laptops or other electronic devices to deliver music, voice or other audio content to a user. In some forms, for example Apple's AirPods™, wireless earbuds include internal electronics such as an onboard power source in the form of a rechargeable battery, audio speaker, microphone, etc., and external features for attachment in, on, around, or over the user's ear. Wireless earbuds may be provided as a single component for use in one ear, or in pairs for use with both ears of the user. In some example forms, wireless earbuds are provided with a container or housing that may include a separate rechargeable battery and electrical contacts for recharging the onboard batteries of the earbuds.

Earbuds and other electronic devices may be particularly prone to damage from exposure to water or moisture, which can damage or destroy electronic components, from impacts such as when dropped, and/or from other potential hazards. While the container or housing provided with some earbuds may provide a small measure of protection, the level of protection may not be adequate for some activities or some users' preferences. Moreover, damage to the container or housing provided with the earbuds may render the earbuds unusable unless or until a replacement container or housing can be obtained.

Accordingly, needs exist for improved protection of electronic devices such as for example, earbuds, charging cases, and/or other devices. It is to the provision of improvements meeting these and other needs that the present disclosure is primarily directed.

SUMMARY

In example embodiments, the present disclosure provides a protective and/or waterproof or water-resistant case for preventing or reducing the likelihood of damage to electronic devices such as for example, earbuds, charging cases, and/or other protected devices. In example forms, the case includes a tough, impact-resistant hard outer shell, and a resilient impact-absorbing soft inner shell surrounding a chamber or cavity for receiving the earbuds or other protected device. In particular embodiments, the earbuds or other protected device may be housed within the chamber or cavity of the case while contained in the charging container or housing provided with the device.

For example, the chamber or cavity of the case may be particularly configured to receive the charging container or housing provided with Apple's AirPods™ or another earbud format. In further examples, the protective case includes a closure mechanism configured to form a waterproof or water-resistant sealing engagement of the case around the earbuds, charging case, and/or other protected device when the closure is engaged. In still further examples, the case includes an offset hinge and cam or lifting arrangement that assists in opening and raising the device container or housing for ease of access to the earbuds or other protected device when the case is opened by a user.

In one example aspect, the present invention relates to a protective case for housing a protected device. The protective case preferably includes an outer shell having a lower outer shell component and an upper outer shell component. The upper and lower outer shell components are preferably hingedly coupled to one another about a case hinge axis. The protective case preferably also includes an inner shell having a lower inner shell component and an upper inner shell component. The lower inner shell component preferably has an exterior configuration configured to be received within an interior chamber of the lower outer shell component, and the upper inner shell component preferably has an exterior configuration configured to be received within an interior chamber of the upper outer shell component. The protective case preferably also includes a closure mechanism movable between an engaged configuration for maintaining the upper and lower outer shell components in a closed position relative to one another to protect the protected device, and a released configuration for allowing the upper and lower outer shell components to open relative to one another to allow access to the protected device.

In another example aspect, the invention relates to a protective case. The case preferably includes a first case component, a second case component, and a first hinged connection coupling the first case component to the second case component for pivotal motion of the first and second case components relative to one another about a first hinge axis. The protective case preferably defines an interior chamber configured to receive and contain a protected device. The protected device preferably comprises a first device portion, a second device portion, and a second hinged connection coupling the first device portion to the second device portion for pivotal motion of the first and second device portions relative to one another about a second hinge axis. The first hinge axis and the second hinge axis are preferably parallel to one another and offset a distance from one another, and the first case component preferably engages the first device portion and the second case component engages the second device portion. Opening and closing the protective case by pivotal motion of the first case component relative to the second case component preferably causes a corresponding opening and closing of the first device portion and the second device portion.

In another example aspect, the invention relates to a method of mating nested hinged containers with eccentric axes for concurrent opening and closing. In example embodiments, the first nested hinged container is a charging housing for earbuds, and the second nested hinged container is a protective case.

These and other aspects, features and advantages of the invention will be understood with reference to the drawing figures and detailed description herein and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

Figure 1:
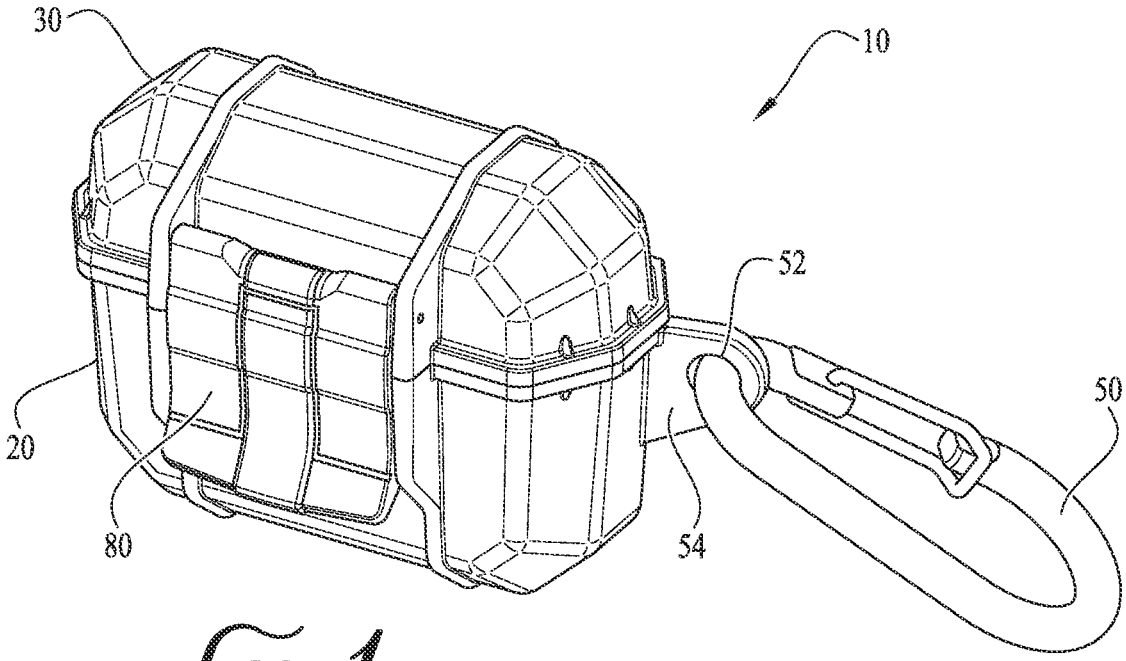
FIG. 1 is a perspective view of a protective case according to an example embodiment of the invention.
Figure 3:
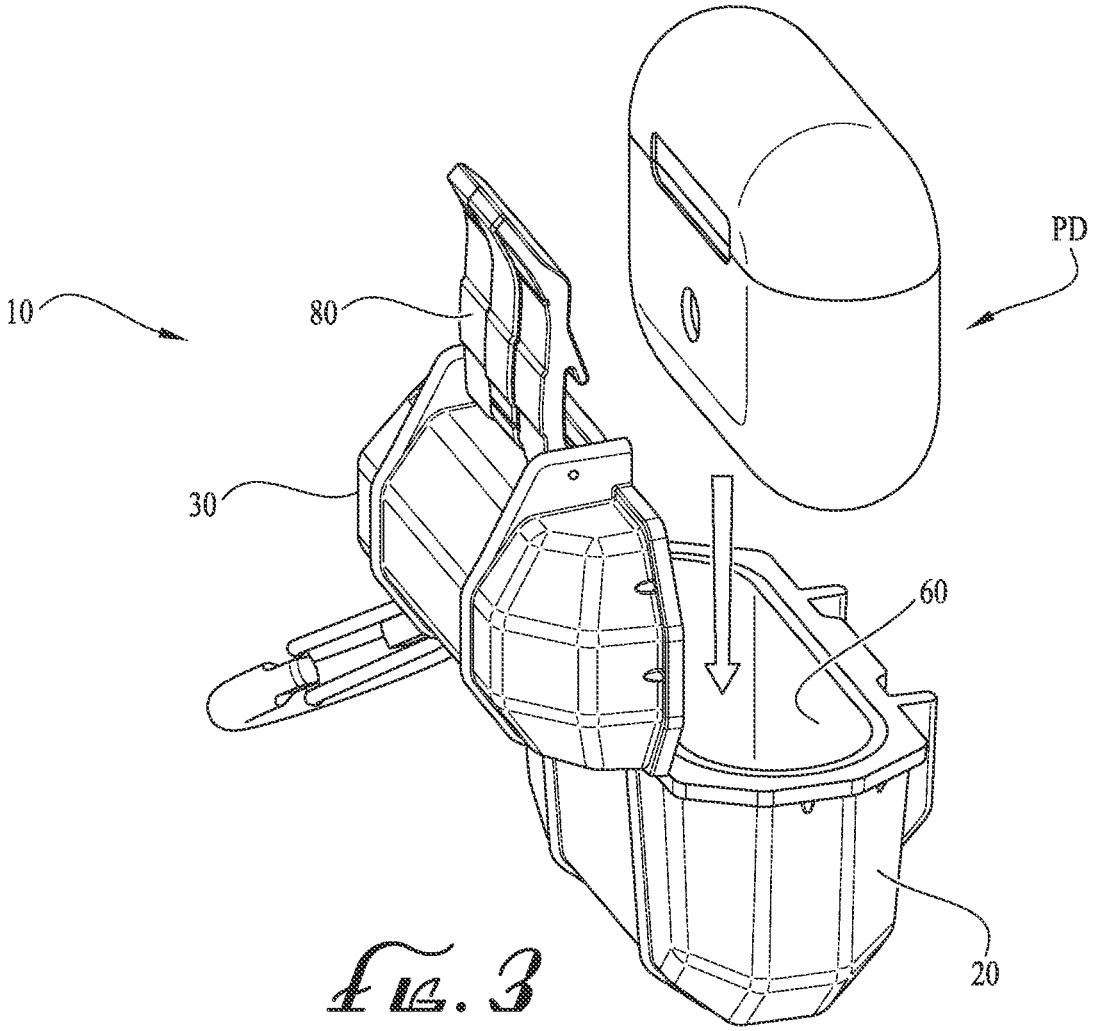
FIG. 3 shows the case of FIG. 1 in an open configuration to receive a protected device in the form of a charging housing for earbuds.
Figure 2:
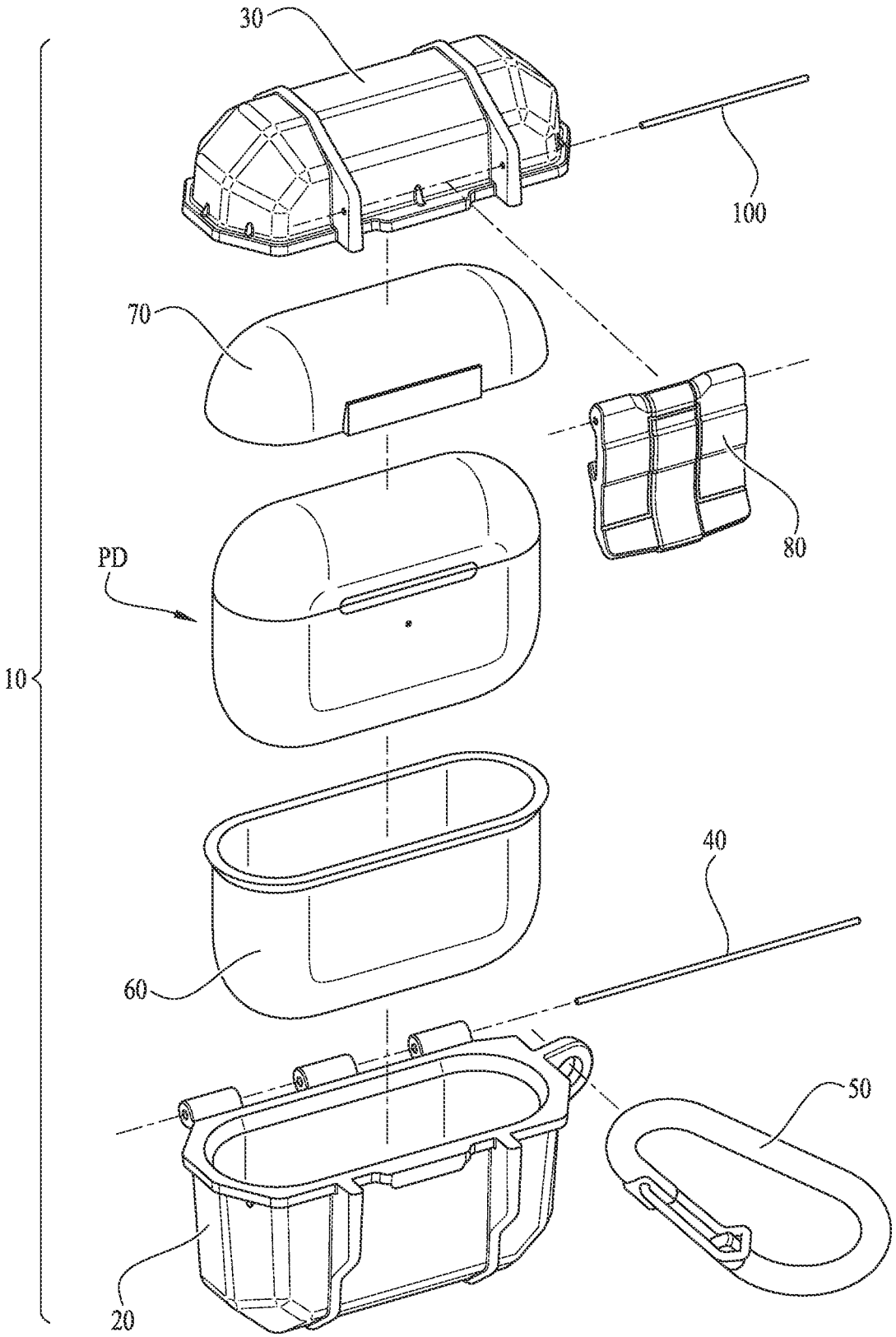
FIG. 2 is an exploded or assembly view showing the components of the case of FIG. 1.

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-6 show example embodiments, features, components and methods of use of a protective case 10 according to the present invention. In particular examples, the case 10 provides protection against damage from impacts and/or waterproof or water-resistant protection against water damage to a protected device PD such as earpods or other small electronic devices. In the depicted examples, the protected device PD takes the form of Apple AirPods™ earbuds housed in their standard original equipment recharging container or charging housing. In alternate embodiments, the protected device may take the form of other types of earbuds, with or without a recharging container, or other electronic non-electronic devices or products to be protected from potential damage from impact and/or water.

The case 10 generally comprises a tough, impact-resistant hard outer shell, a resilient impact-absorbing soft inner shell surrounding a chamber or cavity for receiving the earbuds or other protected device, and a closure and/or sealing arrangement. The outer shell comprises a lower outer shell component 20 and an upper outer shell component 30. The outer shell components 20, 30 are preferably injection molded or otherwise formed from a substantially rigid, tough and impact-resistant material such as polycarbonate (PC), Acrylonitrile butadiene styrene (ABS), Nylon, polystyrene, and/or other hard plastic or polymeric material(s) of construction, or alternatively may be formed from metal, wood and/or other material(s). The outer shell components 20, 30 preferably have a material thickness sufficient to provide the desired level of impact protection, and optionally may include reinforcing ribs, flanges or other structural elements for improved strength. The outer shell components 20, 30 are preferably continuous and water-impervious, without openings through the shells that could permit water or debris to enter the case 10 when closed.

A case hinge rod or primary hinge rod 40 is press fit through hinge sleeves, grooves or ferrules 22, 32 to hingedly or pivotally couple the lower outer shell component 20 to the upper outer shell component 30. In example embodiments, the primary hinge rod 40 comprises a stainless steel (SS) pin or rod. Optionally, a carabiner 50 or other carrying or attachment component is affixed to the case 10, for example through a loop or opening 52 in a flange 54 projecting externally from the lower outer shell component 20.

The inner shell comprises a lower inner shell component 60 and an upper inner shell component 70. The lower inner shell component 60 has an exterior configuration shaped and sized to fit closely within an internal chamber of the lower outer shell component 20, and an interior configuration shaped and sized to receive a lower portion of the protected device PD. The upper inner shell component 70 has an exterior configuration shaped and sized to fit closely within an internal chamber of the upper outer shell component 30, and an interior configuration shaped and sized to receive an upper portion of the protected device PD. The lower and upper inner shell components 60, 70 are preferably molded or otherwise formed from a resilient impact-absorbing soft material such as thermoplastic polyurethane (TPU), silicone, and/or other thermoplastic elastomer (TPE) or soft elastomeric materials. The lower and upper inner shell components 60, 70 preferably have a material thickness sufficient to provide the desired level of impact absorption, and surface properties providing the desired sealing and material contact and release properties. The inner shell components 60, 70 are preferably continuous and water-impervious, without openings through the shells that could permit water or debris to enter the case 10 when closed.

The case 10 further comprises a locking clip or closure latch component 80. The locking clip 80 is hingedly or pivotally coupled to the upper outer shell component 30 by a latch hinge rod or secondary hinge rod 100 that is press fit through one or more sleeves, grooves, ferrules, or holes 102 in the proximal end 82 of the locking clip 80 and through one or more cooperating sleeves, grooves, ferrules, or holes 104 in or on flanges 106 projecting outwardly from the upper outer shell component 30. In example embodiments, the secondary hinge rod 100 comprises a stainless steel (SS) pin or rod. The locking clip 80 further comprises a free distal end 84 optionally having a ribbed or knurled actuation surface, and latch engagement fin or flange 86 projecting obliquely inwardly and proximally from a medial portion of the inward face of the locking clip, between its proximal and distal ends 82, 84.

In example method of use, a user can latch and release the locking clip 80 to secure the case 10 closed and to allow the case to be opened. Pressing the distal end 84 to pivot the locking clip 80 downward and inward results in a snap-fit coupling by resilient or plastic deformation as the latch engagement fin 86 moves over and into releasable engagement with a cooperating lip or flange 26 projecting outwardly and downwardly from an upper front rim area of the lower outer shell component 20, to secure the case in a closed configuration with the upper and lower shell portions closely engaging one another. Lifting the distal end 84 to pivot the locking clip 80 upward and outward releases the latch engagement fin 86 from engagement with the lip or flange 26 of the lower outer shell component 20, to allow the case to be opened by pivoting the upper shell portion away from the lower shell portion.

The case 10 preferably comprises a waterproof or water-resistant sealing arrangement between the upper and lower shells to prevent water or debris from entering the case when the case is closed. In example embodiments, the upper outer shell component 30 comprises an inwardly directed and outwardly projecting lip or rib 34 at least partially around its lower rim, which is squeezed into contact with an expanded upper rim portion 62 of the resilient lower inner shell component 60 to form a compressive seal around the interface between the upper and lower shell portions when the case 10 is closed. Engagement of the locking clip 80 to secure the case 10 in its closed configuration preferably provides a positive waterproof or highly water-resistant seal engagement between the upper and lower shells, with the hard plastic rim of the upper outer shell component 30 elastically compressing the softer material of the lower inner shell component 60 to form the seal interface.

Figure 4B:
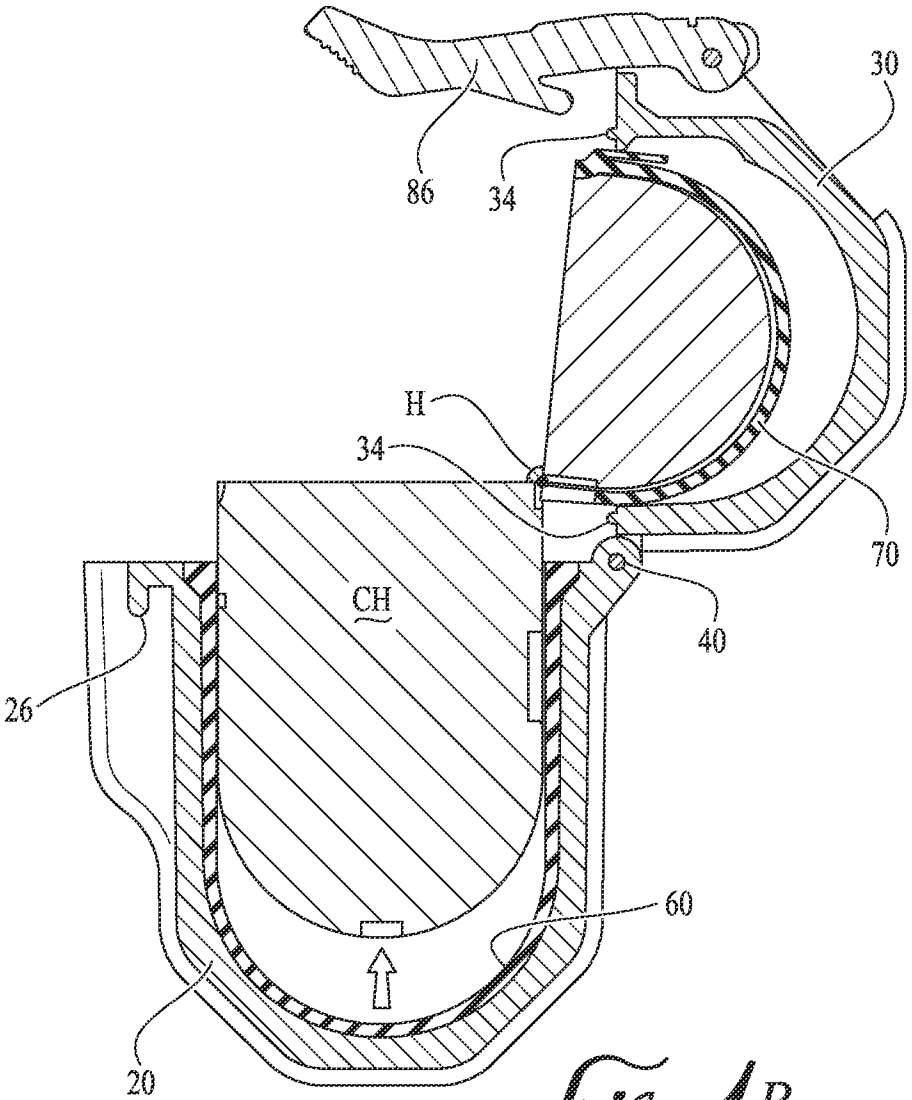
FIGS. 4A and 4B show further details of the case of FIG. 1 in cross-sectional view, with the case in closed and open configurations respectively.
Figure 4A:
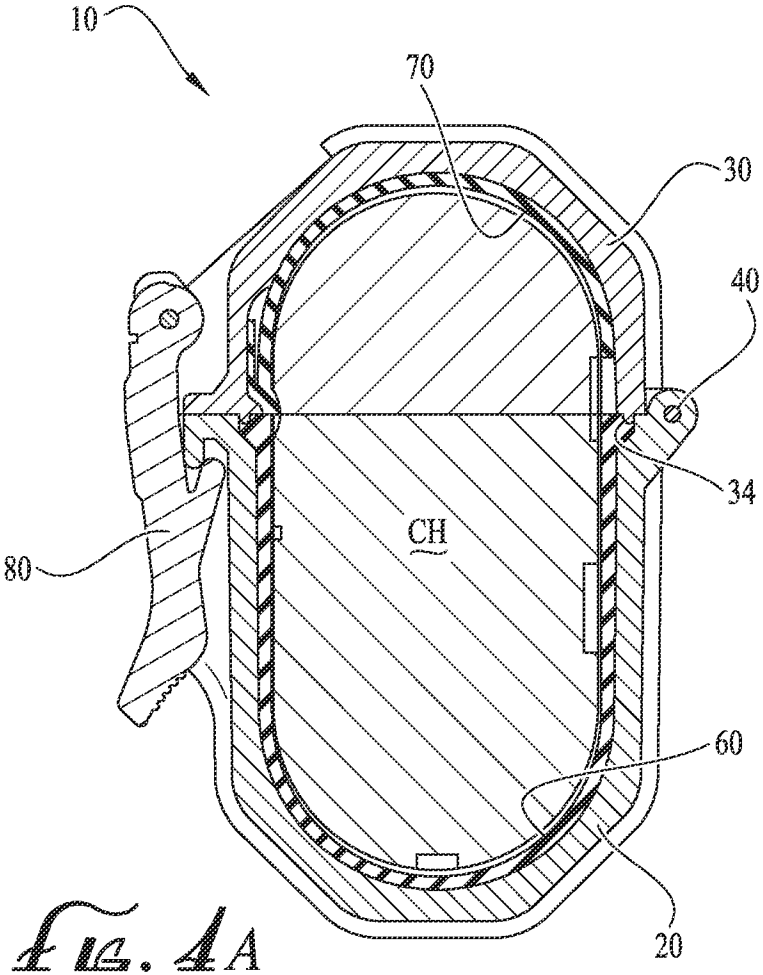
Figure 5B:
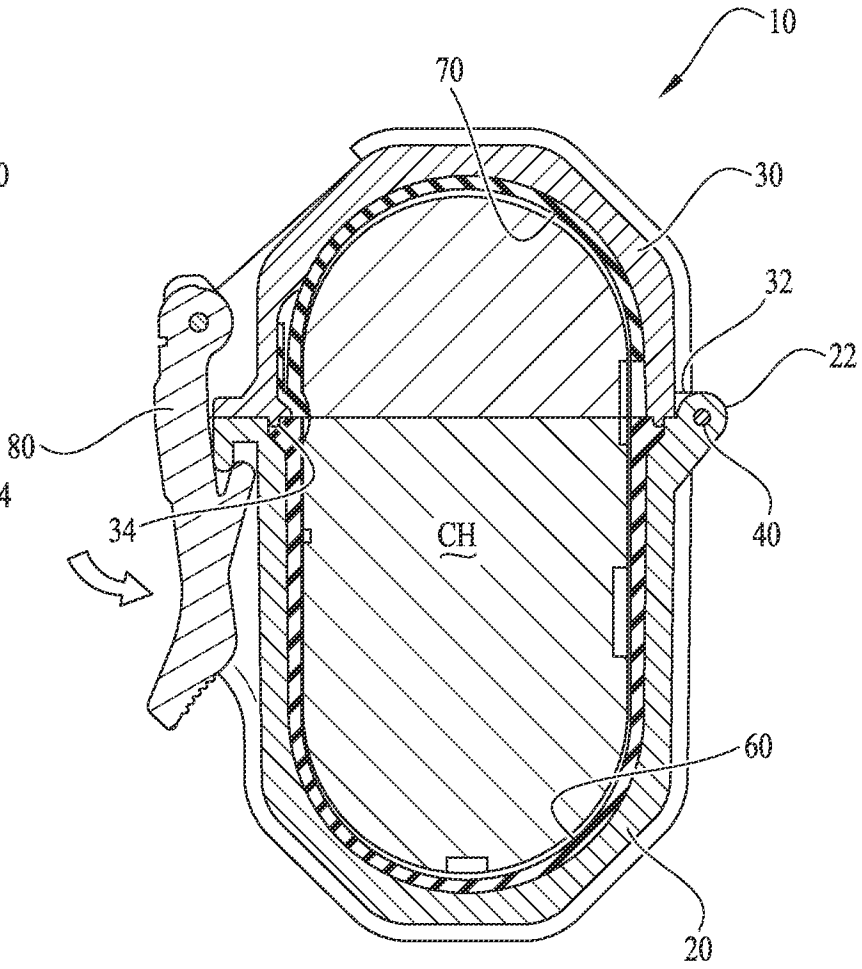
FIGS. 5A and 5B show further details of the case of FIG. 1 in cross-sectional view, with the closure latch mechanism in open and closed configurations respectively.
Figure 5A:
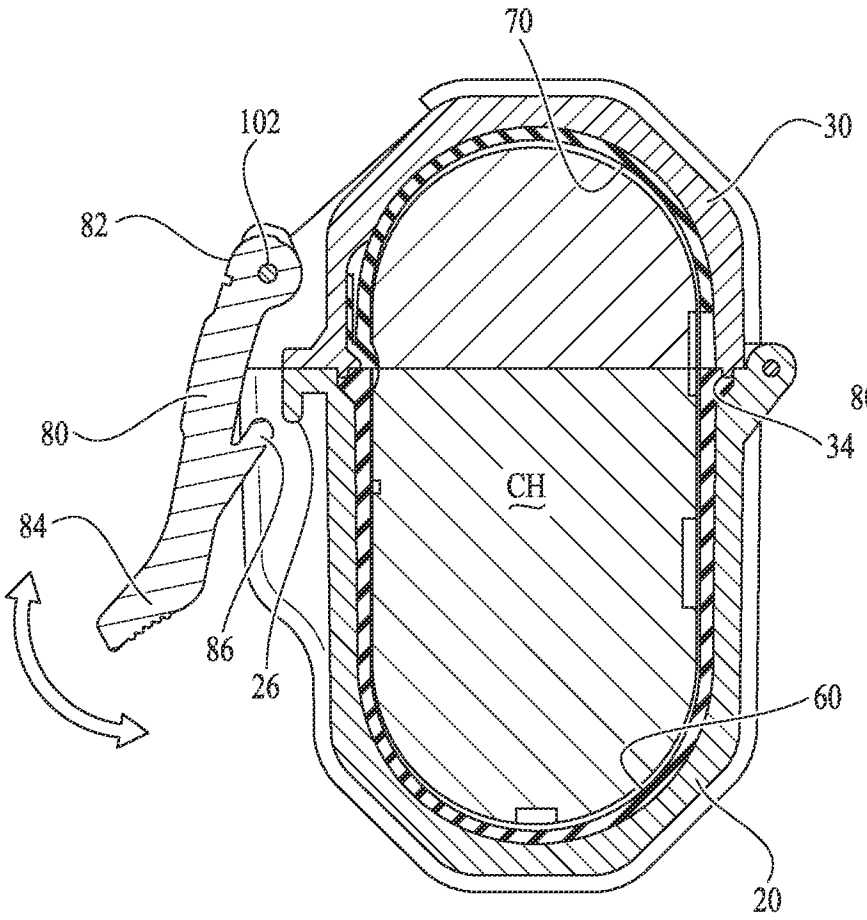
Figure 6B:
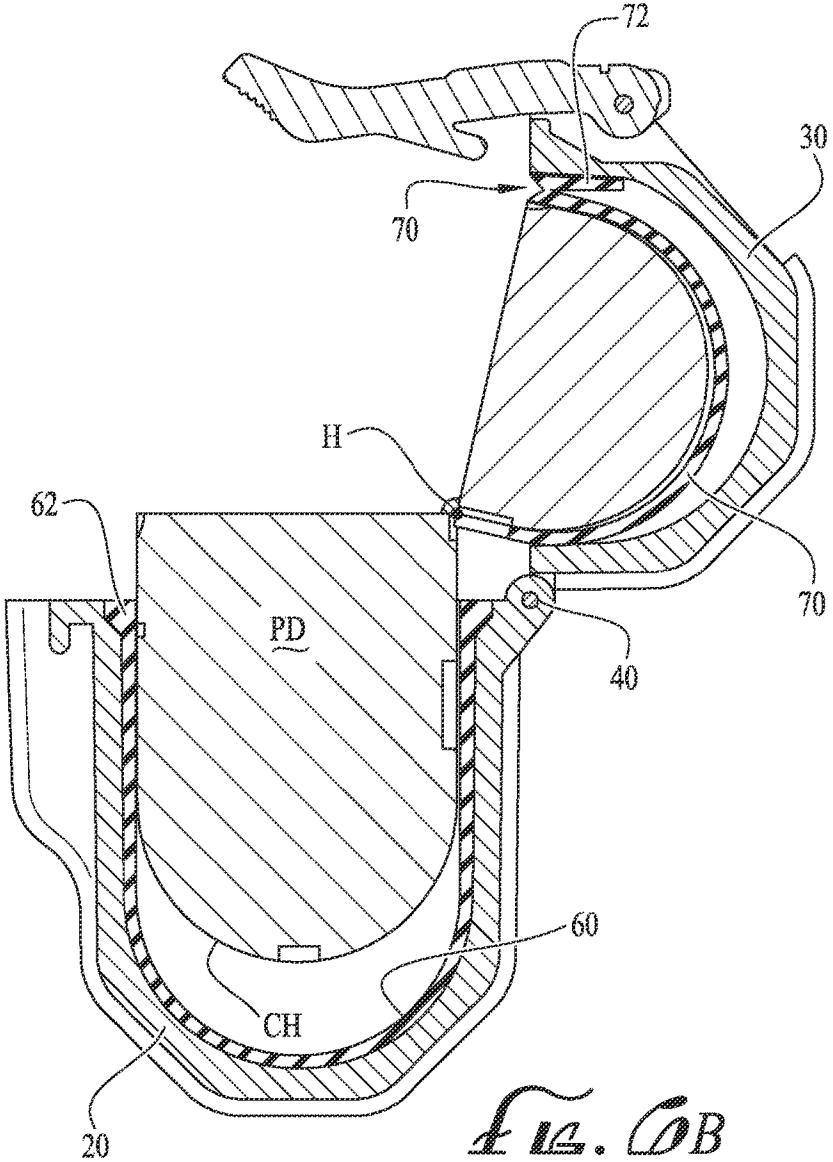
FIGS. 6A and 6B show cross-sectional views of a protective case according to an example embodiment of the invention, with the case in closed and open configurations respectively.
Figure 6A:
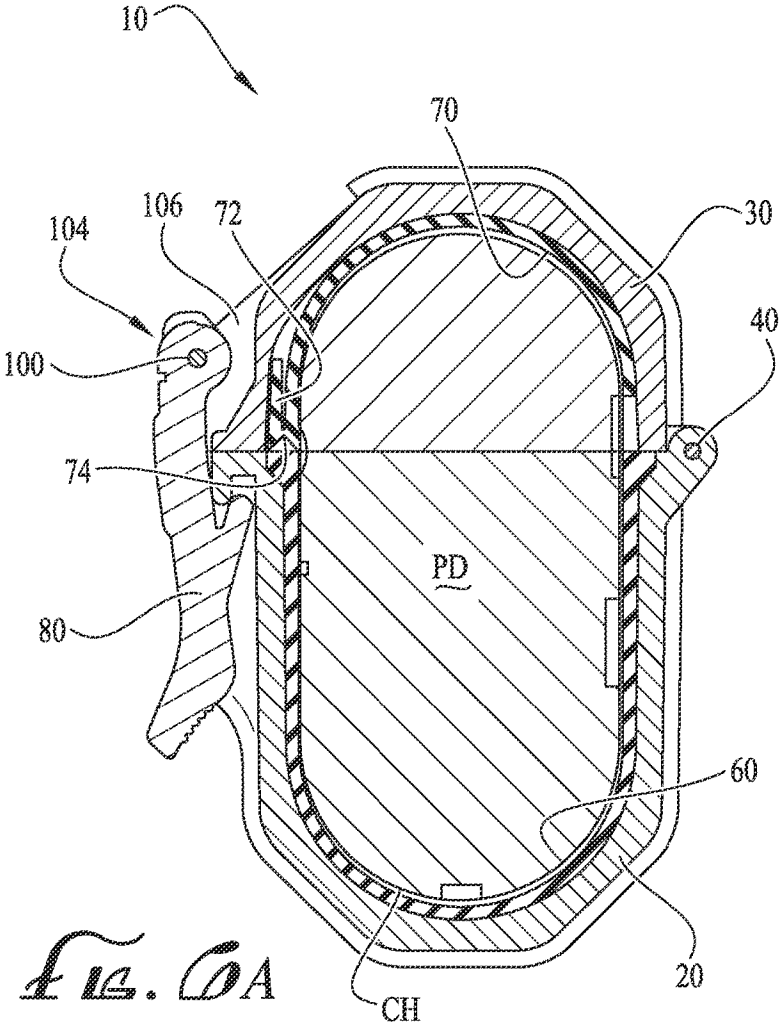
Figure 7:
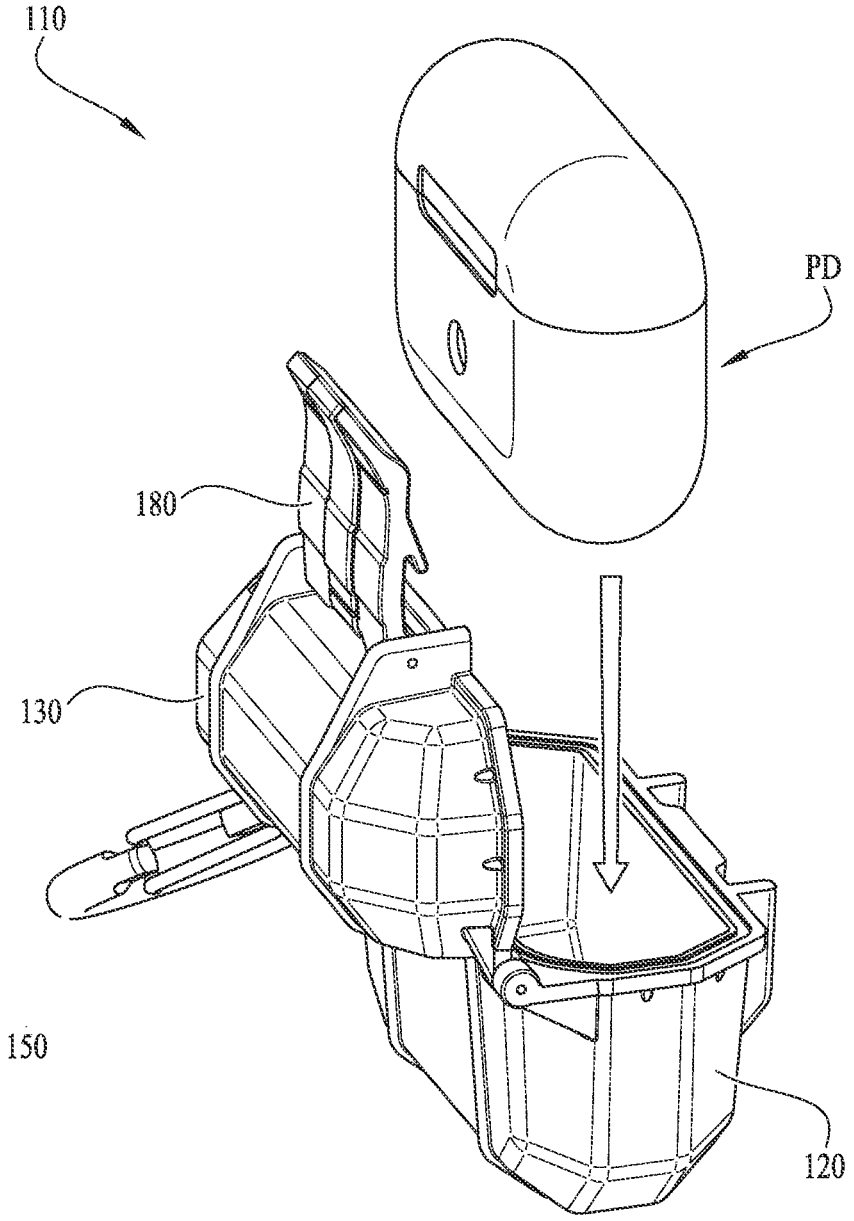
FIG. 7 is a perspective view of a protective case according to another example embodiment of the invention, in an open configuration to receive a protected device in the form of a charging housing for earbuds.
Figure 8:
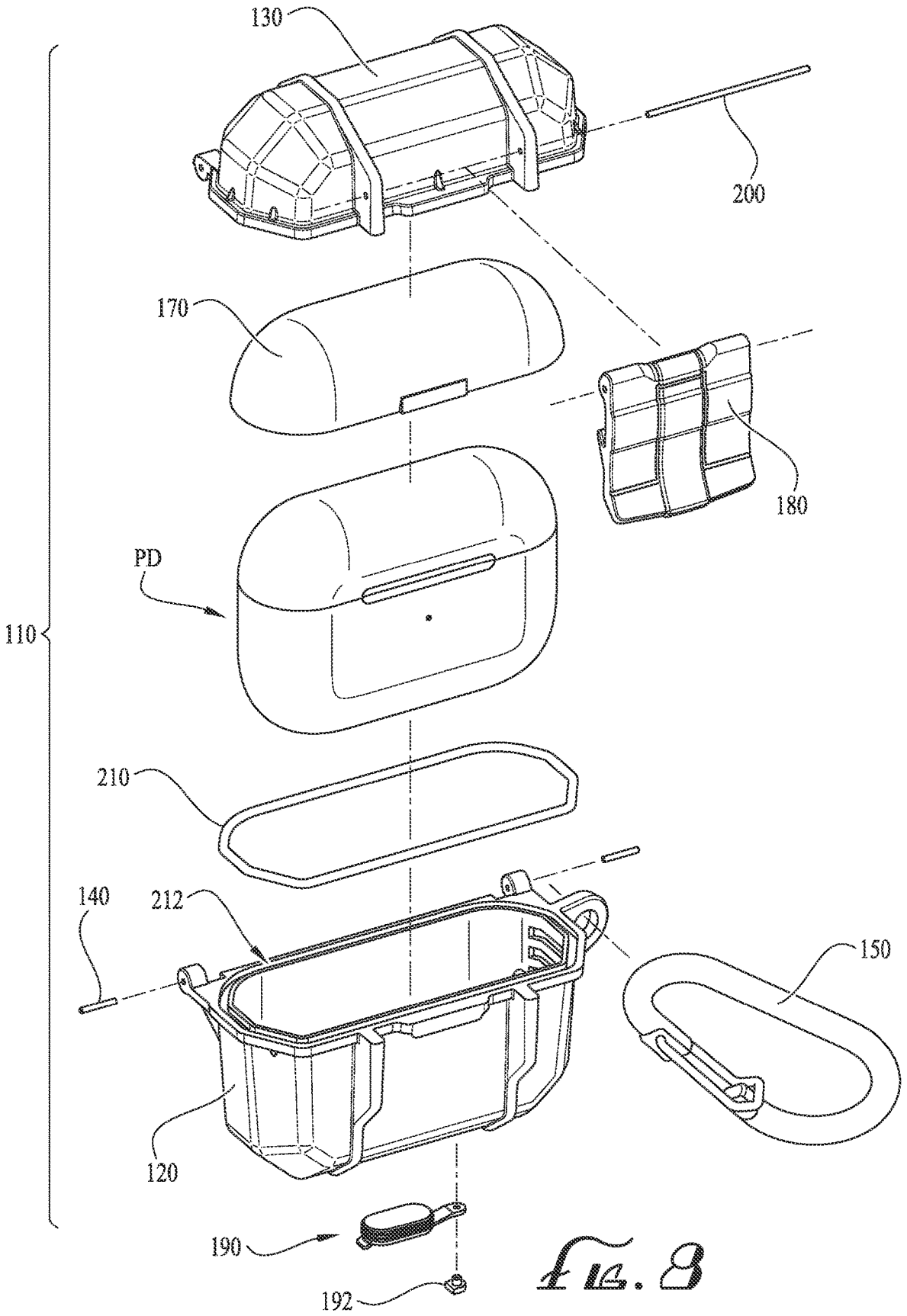
FIG. 8 is an exploded or assembly view showing the components of the case of FIG. 7.
Figure 10:
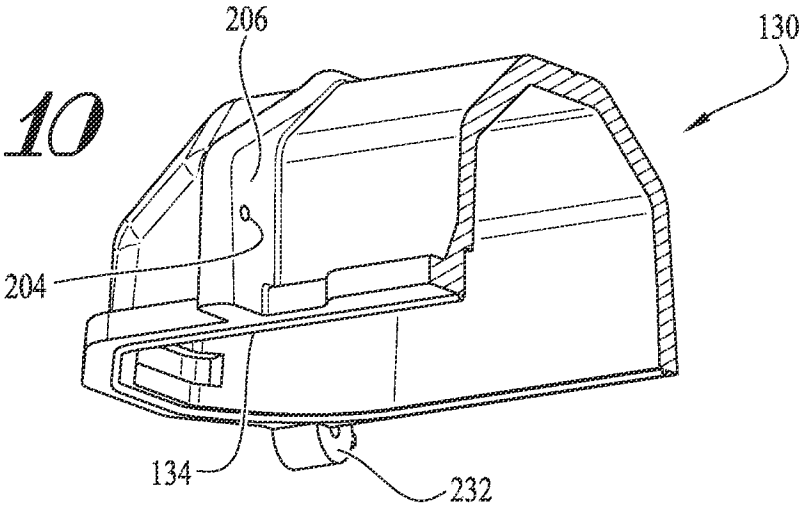
FIG. 10 shows further details of a top housing shell portion of the case of FIG. 7, in partial cross-section.
Figure 11:
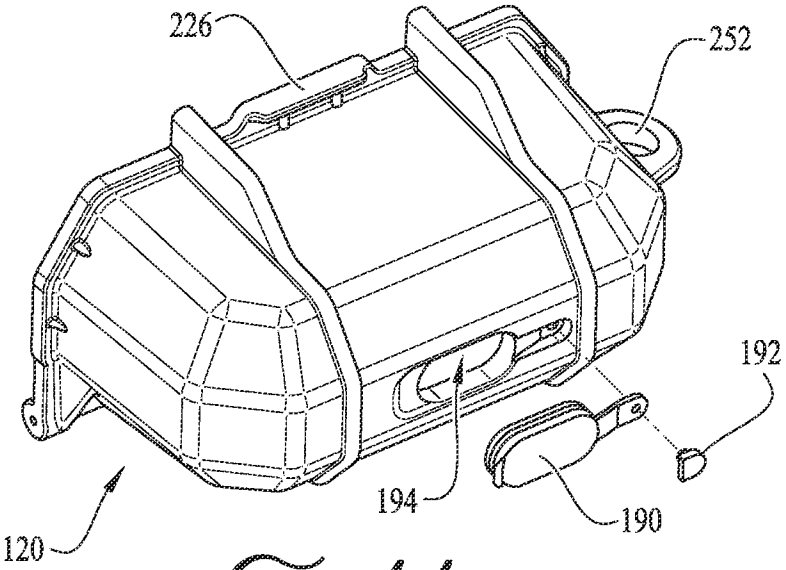
FIG. 11 shows further details of a bottom housing shell portion of the case of FIG. 7, in partial cross-section.
Figure 9:
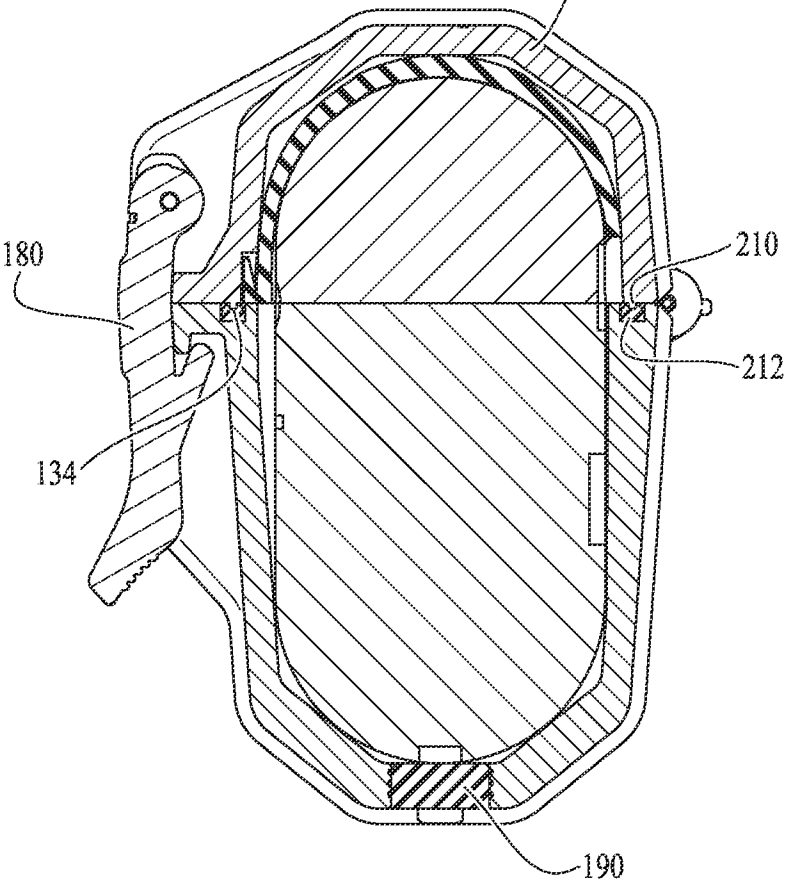
FIG. 9 shows further details of the case of FIG. 7 in cross-sectional view.

The case 10 preferably comprises an offset hinge and cam arrangement that assists in opening and raising the protected device PD for ease of access when the case is opened by a user. As seen best with reference to FIGS. 4A and 4B and FIGS. 6A and 6B, the upper inner shell component 70 comprises an attachment flap 72 extending outwardly and upwardly from a front portion of its lower rim. The attachment flap 72 preferably comprises an integral or unitary portion of the upper inner shell component 70, with a living hinge 74 formed by an area of reduced material thickness at its line of connection. The attachment flap 72 may be affixed to the inside face of the front lower rim area of the upper outer shell component 30 only, for example by permanent glue or other attachment means, with the remainder of the upper inner shell component 70 able to decouple freely from the upper outer shell component 30 as shown in FIGS. 4B and 6B. The lower inner shell component 60 may optionally be formed as an over-mold with or otherwise affixed to the lower outer shell component 20. The inside contour of the upper inner shell component 70 closely conforms to and grips the top cover of the charging housing CH of the protected device PD, while the lower inner shell component 60 provides a running or sliding fit with the bottom cover of the charging housing of the protected device. Thus, when the case 10 is opened, the top cover of the charging housing CH of the protected device PD follows the upper inner shell component 70 as it opens, while the bottom cover of the charging housing of the protected device can slide up and down within the lower inner shell component 60.

Because the hinge H of the charging housing CH of the protected device PD is offset a distance from the hinge formed by the primary hinge rod 40 of the case 10, the pivotal movement of the charging housing CH of the protected device PD is eccentric (not coaxial) with the pivotal movement of the case 10. This configuration enables a method of mating nested hinged containers with eccentric axes for concurrent opening and closing. The upper inner shell component 70 can move independently of the upper outer shell component 30, pivoting about the living hinge 74 of the attachment flap 72. As the upper outer shell component 30 is opened, the lower back rim of the upper outer shell component acts as a cam or fulcrum against the upper inner shell component 70 and opens the top cover of the charging housing CH engaged within the upper inner shell component. The upper outer shell component 30 acts as a lever about this cam or fulcrum, lifting the bottom cover of the charging housing CH upward relative to the lower outer shell component 20 and the lower inner shell component 60, for improved access to the protected device PD. Closing the case 10 operates in reverse, to close the charging housing CH of the protected device PD, lower the charging housing back into the case, and close the case. In alternate embodiments, the protective case 10 may incorporate a spring actuated lifting mechanism, an elastically resilient bumper, or other means for lifting the charging housing or other protected device upward relative to the lower outer shell component of the case for improved accessibility.

FIGS. 7-11 show another example embodiment of a protective case 110. The case 110 generally comprises a tough, impact-resistant hard outer shell, optionally having an impact-absorbing inner shell or lining 170, surrounding a chamber or cavity for receiving the earbuds or other protected device PD, and a closure and/or sealing arrangement. The outer shell comprises a lower outer shell component 120 and an upper outer shell component 130. The outer shell components 120, 130 may be injection molded or otherwise formed from a substantially rigid, tough and impact-resistant material such as polycarbonate (PC), Acrylonitrile butadiene styrene (ABS), Nylon, polystyrene, and/or other hard plastic or polymeric material(s) of construction, or alternatively may be formed from metal, wood and/or other material(s). The outer shell components 120, 130 preferably have a material thickness sufficient to provide the desired level of impact protection, and optionally may include reinforcing ribs, flanges or other structural elements for improved strength.

A case hinge rod or primary hinge rod 140 is press fit through hinge sleeves of the shell components to hingedly or pivotally couple the lower outer shell component 120 to the upper outer shell component 130. In example embodiments, the primary hinge rod 40 comprises a stainless steel (SS) pin or rod. Optionally, a carabiner 150 or other carrying or attachment component is affixed to the case 110, for example through a loop or opening 252 in a flange projecting externally from the lower outer shell component 120.

The case 110 further comprises a locking clip or closure latch component 180. The locking clip 180 is hingedly or pivotally coupled to the upper outer shell component 130 by a latch hinge rod or secondary hinge rod 200 that is press fit through holes in the proximal end of the locking clip 180 and through one or more cooperating holes 204 in or on flanges 206 projecting outwardly from the upper outer shell component 130. In example embodiments, the secondary hinge rod 200 comprises a stainless steel (SS) pin or rod. The locking clip 180 further comprises a free distal end optionally having a ribbed or knurled actuation surface, and latch engagement fin or flange projecting obliquely inwardly and proximally from a medial portion of the inward face of the locking clip, between its proximal and distal ends.

A user can latch and release the locking clip 180 to secure the case 110 closed and to allow the case to be opened. Pressing the locking clip 180 downward and inward results in a snap-fit coupling by resilient or plastic deformation as the latch engages with a cooperating lip or flange 226 projecting outwardly and downwardly from an upper front rim area of the lower outer shell component 120, to secure the case in a closed configuration with the upper and lower shell portions closely engaging one another. Lifting the distal end to pivot the locking clip 180 upward and outward releases the latch from engagement with the lip or flange 226 to allow the case to be opened by pivoting the upper shell portion away from the lower shell portion.

The case 110 preferably comprises a waterproof or water-resistant sealing arrangement between the upper and lower shells 130, 120 to prevent water or debris from entering the case when the case is closed. In example embodiments, the upper outer shell component 130 comprises a downwardly and outwardly projecting rib 134 extending at least partially around its lower rim, which is squeezed into contact with a sealing gasket 210 engaged within a channel 212 formed within the top face or rim of the lower shell 120. The sealing gasket 210 optionally comprises silicone, thermoplastic polyurethane (TPU), neoprene, or other soft plastic, polymeric, rubber, cork, or other compressible and elastically resilient material suitable to form a compressive seal around the interface between the upper and lower shell portions when the case 110 is closed. In alternate embodiments, the sealing gasket may comprise an O-ring of silicone, neoprene or other material. Engagement of the locking clip 180 to secure the case 110 in its closed configuration preferably draws the shells 120, 130 of the housing into sealing engagement and provides a positive waterproof or highly water-resistant seal engagement at the seal interface between the rib 134 and the gasket 210.

The protective case 110 optionally comprises an offset hinge and cam arrangement in similar fashion to the above-described embodiment, that assists in opening and raising the protected device PD for ease of access when the protective case is opened by a user. If provided, opening the protective case 110 opens the charging housing of a protected device PD, such as a charging housing for earbuds, and lifts the protected device within the protective case for ease of access to earbuds or other items. Closing the case 110 operates in reverse, to close the charging housing of the protected device PD, lower the charging housing back into the case, and close the case. In alternate embodiments, the protective case 110 may incorporate a spring actuated lifting mechanism, an elastically resilient bumper, or other means for lifting the charging housing or other protected device upward relative to the lower outer shell component of the case for improved accessibility.

The protective case 110 optionally further comprises a charging port 194 for access to a charging jack of the protected device PD to provide an electrical charge for batteries of the protected device and/or items stored therein. For example, the charging port 194 may comprise an opening through the lower shell 120, configured for alignment with a corresponding charging jack of the protected device PD when stored in the case 110. If provided, the charging port 194 preferably includes an openable and reclosable sealing closure or cover 190 affixed to the lower shell 120, for example by a fastener or attachment means 192 for securing a flexible strap of the cover to the shell. In example embodiments, the cover 190 is formed of silicone, thermoplastic polyurethane (TPU) or other soft plastic, polymeric, rubber, cork, or other compressible and elastically resilient material suitable, and is sized and shaped to form a waterproof or water-resistant seal around the opening of the charging port 194.

While the invention has been described with reference to example embodiments, it will be understood by those skilled in the art that a variety of modifications, additions and deletions are within the scope of the invention, as defined by the following claims.

What is claimed is:

1. A protective case for covering a protected device comprising a housing, the protective case comprising:

an outer shell comprising a lower outer shell component and an upper outer shell component, the upper and lower outer shell components being hingedly couples to one another about a case hinge axis;

an inner shell comprising a lower inner shell component and an upper inner shell component, wherein the lower inner shell component has an exterior configuration configured to be received within the lower outer shell component, and wherein the upper inner shell component has an exterior configuration configured to be received within the upper outer shell component; and a closure mechanism movable between an engaged configuration for maintaining the upper and lower outer shell components in a closed position relative to one another to protect the protected device, and a released configuration for allowing the upper and lower outer shell components to open relative to one another to allow access to the protected device, wherein the housing is at a first distance from the lower inner shell component within the lower outer shell component when the case is opened and at a second distance from the lower inner shell component within the lower outer shell component when the vase is closed, wherein the first distance is greater than the second distance.

2. The protective case of claim 1, wherein a waterproof or water-resistant seal is formed between at least one of the upper shell components and at least one of the lower shell components when the case is in the closed position with the closure mechanism in the engaged configuration.

3. The protective case of claim 2, wherein the waterproof or water-resistant seal is formed between the upper outer shell component and the lower inner shell component.

4. The protective case of claim 1, wherein the lower outer shell component and the upper outer shell component comprise a hard impact-resistant material, and wherein the lower inner shell component and the upper inner shell component comprise a soft impact absorbing material.

5. The protective case of claim 1, wherein the housing is configured to slider within the lower inner shell component when the protective case is opened and closed.

6. The protective case of claim 1, wherein the upper inner shell component is partially affixed to the upper outer shell component by a living hinge of flexible material.

7. The protective case of claim 1, further comprising a sealing gasket arranged between at least one of the upper shell components and at least one of the lower shell components to form a water-resistant seal when the case is in the closed position with the closure mechanism in the engaged configuration.

8. The protective case of claim 1, further comprising a charging port extending through the outer shell, and a sealing closure movable between a closed and sealed configuration preventing passage through the charging port and an open configuration allowing passage through the charging port.

9. The protective case of claim 1, further comprising a carabiner clip for attachment of the case to an external object.

10. A protective case comprising a first case component a second case component, a first hinged connection coupling the first case component to the second case component for pivotal motion of the first and second case components relative to one another about a first hinge axis, the protective case defining an interior chamber configured to receive and contain a protected device, wherein the protected device comprises a first device portion, a second device portion, and a second hinged connection coupling the first device portion to the second device portion for pivotal motion of the first and second device portions relative to one another about a second hinge axis, wherein the first hinge axis and the second hinge axis are parallel to one another and offset a distance rom one another, wherein the first case component is engaged to the first device portion and the second case component is engaged to the second device portion, and wherein the first device portion is configured to open and close relative to the second device portion when the first case component is opened and closed relative to the second case component, respectively, and wherein one of the first and second device portions is configured to translate upwards within the interior of the interior chamber when the first case component is pivoted open relative to the second case component.

11. The protective case of claim 10, wherein one of the first and second device portions is configured to translate downward within the interior of the interior chamber when the first case component is pivoted closed relative to the second case component.

12. The protective case of claim 10, further comprising at least one sealing element forming a water-resistant seal between the first and second case components when the case is closed.

13. The protective case of claim 12, wherein the at least one sealing element comprises a resilient compressible gasket.

14. The protective case of claim 10, further comprising a charging port extending through one of the first or second case components, and a sealing closure movable between a closed and sealed configuration preventing passage through the charging port and an open configuration allowing passage through the charging port.

15. The protective case of claim 14, wherein the charging port is configured for alignment with a charging jack of the protected device.

16. The protective case of claim 10, further comprising a carabiner clip for attachment of the case to an external object.

17. The protective case of claim 10, wherein the first and second case components comprise a hard impact-resistant material.

18. The protective case of claim 17, further comprising an inner portion comprising a soft impact absorbing material.

* * * * *